US009775760B1

(12) United States Patent
Roy

(10) Patent No.: US 9,775,760 B1
(45) Date of Patent: Oct. 3, 2017

(54) CREMATION URN AND METHODS OF MANUFACTURE

(71) Applicant: Donald J. Roy, Agawam, MA (US)

(72) Inventor: Donald J. Roy, Agawam, MA (US)

( * ) Notice: Subject to any disclaimer, the term of this patent is extended or adjusted under 35 U.S.C. 154(b) by 42 days.

(21) Appl. No.: 14/704,435

(22) Filed: May 5, 2015

(51) Int. Cl.
*A61G 17/08* (2006.01)
*A61G 99/00* (2006.01)

(52) U.S. Cl.
CPC ..... *A61G 17/08* (2013.01); *A61G 99/00* (2013.01)

(58) Field of Classification Search
CPC ..... A61G 17/08; A61G 99/00; E04H 13/008; B65D 41/04; B65D 39/084
USPC ..... 27/1, 35; 211/85.27; D99/5; 40/124.5; 220/288
See application file for complete search history.

(56) References Cited

U.S. PATENT DOCUMENTS 900,980 A 10/1908 Callahan et al.
1,048,361 A 12/1912 Siebert
1,454,427 A 5/1923 Cunning
1,484,896 A 2/1924 Mannix
1,903,197 A 3/1933 Scott
1,974,666 A 9/1934 Scott
2,235,617 A * 3/1941 Klinzing ..... A61G 17/08 220/288
2,261,651 A 11/1941 Lambert
2,385,520 A * 9/1945 Klinzing ..... A61G 17/08 220/288
3,654,676 A 4/1972 McHugh
4,170,054 A 10/1979 Ruffner et al.
4,320,562 A 3/1982 Kelley
4,372,018 A 2/1983 Miller, IV et al.
4,823,448 A 4/1989 Martin
4,854,018 A 8/1989 Von Bratt
5,157,817 A 10/1992 Davidian
5,203,810 A 4/1993 Davidian
5,245,733 A 9/1993 Goria
5,379,499 A 1/1995 Jackson
5,722,133 A 3/1998 Farris et al.
5,732,452 A 3/1998 Riedel, II
D400,683 S 11/1998 Saaf et al.
6,023,822 A * 2/2000 Luebke ..... A61G 17/08 27/1
6,145,175 A 11/2000 Enneking et al.
6,295,705 B1 * 10/2001 Gersten ..... A61G 17/08 220/4.27
7,178,209 B1 * 2/2007 Radziewicz ..... A61G 17/08 27/1
8,087,132 B2 * 1/2012 Forrest ..... A61G 17/08 27/1
8,418,329 B2 * 4/2013 Davis ..... A61G 17/08 27/1

(Continued)

*Primary Examiner* — William Miller

(57) ABSTRACT

A cremation urn comprising an internal structure with an opening, an external opening with an opening that is correspondingly aligned with the opening on the internal structure, and sealing means in the form of a threaded lid or press fit lid. A threaded flange is attached to the opening on the internal structure and is molded into the urn during manufacturing. The materials used for the urn produce an urn with the appearance of marble. Once the urn is made, by use of a manufacturing method, the threaded lid is screwed into the threaded flange, thereby creating a one-piece, air-tight and water-tight cremation urn.

18 Claims, 6 Drawing Sheets

(56) References Cited

U.S. PATENT DOCUMENTS

| | | | | |
|---|---|---|---|---|
| 8,898,873 | B2 * | 12/2014 | Bailey | A61G 17/08 27/1 |
| 9,155,673 | B2 * | 10/2015 | Bailey | A61G 17/007 |
| 2003/0024089 | A1 * | 2/2003 | Dziekonski | A61G 17/0076 27/1 |
| 2007/0084027 | A1 * | 4/2007 | Walczak | A61G 17/08 27/1 |
| 2009/0020488 | A1 | 1/2009 | Turkel | |
| 2010/0088866 | A1 | 4/2010 | Fifer et al. | |
| 2013/0125357 | A1 | 5/2013 | Drew et al. | |
| 2014/0000075 | A1 | 1/2014 | Catlett | |
| 2014/0090216 | A1 | 4/2014 | Kotila et al. | |

* cited by examiner

CREMATION URN AND METHODS OF MANUFACTURE

TECHNICAL FIELD

The invention generally pertains to burial or cremation urns, and more particularly to a one-piece, seamless cremation urn having an internal structure for maintaining ashes surrounded by an external decorative and support structure.

BACKGROUND ART

Throughout the world them are numerous methods of dealing with a person after they have died. For thousands of years one of the most widely used methods has been to bury the corpse of a dead person, with a marker such as a tombstone indicating where a person is buried. Eventually, in cities or towns where large groups of people live certain areas have been where designated so that many corpses could be buried in one location. These locations came to be called a cemetery. There were also alternative locations such as below-ground catacombs or above-ground mausoleums. By the $20^{th}$ century in most western countries it was common to have a cemetery along with a mausoleum which gave people an option of where to place their loved ones remains.

As time has progressed it has become apparent that burying a dead person, along with a coffin, or placing a dead person and coffin in a mausoleum requires a significant amount of space for each person. The cost of providing a coffin and a cemetery or mausoleum gravesite is also significant.

The answer to this situation has actually also long existed and consists of simply burning the corpse of a dead person. Burning, or cremating, a corpse does not require an expensive coffin and the ashes that remain can be easily buried, placed in a mausoleum, scattered in an appropriate location, or even kept by the family.

Typically, when a loved one's ashes are placed in a mausoleum or kept by the family, a burial or cremation urn is utilized to maintain the ashes. There are many types, styles, shapes and sizes of cremation urns. Unfortunately, there have been problems with cremation urns. It is important to remember that cremated ashes are an organic material. Placing the ashes in a common urn with a simple lid, allows both air and moisture to interact with the ashes, often with negative results. Also urns are sometimes made of a fragile material that if dropped or impacted can break, thereby spilling the ashes.

In order to provide a solution to these problems cremation urns have been developed that include an inner storage container for the ashes and an outer decorative container. Both containers are optimally made of a durable material which will not break if dropped or impacted. Even though these modem cremation urns do solve some of the problems, there is still an issue with the manufacturing process which creates an urn with seams from multiple sections that are attached together. The seams allow air and moisture to enter, which remains one of the major original problems.

The solution is to create/provide a cremation urn that includes an inner ash container surrounded by an outer container, which allows for the safe storage and transportation of ashes. The cremation urn should be manufactured by a method that does not leave any seams or other openings into which air or moisture can enter the urn and damage the ashes within.

A search of the prior art did not disclose any literature or patents that read directly on the claims of the instant invention. However, the following U.S. patents are considered related:

| Pat. No. | INVENTOR | ISSUED |
|---|---|---|
| 5,203,810 | Davidian | 20 Apr. 1993 |
| 5,732,452 | Riedel II | 31 Mar. 1998 |
| 009/0070488A1 | Turkcl | 22 Jan. 2009 |

The U.S. Pat. No. 5,203,810 discloses a method of making a concrete structure, such as a burial vault, having an integrally bonded thermoplastic resin liner. The liner is a rigid molded product having a bottom wall and side walls and an open top. A thermos-setting resin adhesive is applied to the outer surface of the liner and consists of an epoxy resin system, a solvent for the thermoplastic liner, and a surfactant. Before the adhesive is fully cured, wet flowable concrete is applied to the adhesive layer. The solvent acts to solubilize the outer surface of the plastic liner, while the surfactant provides a firmly bonded composite structure.

The U.S. Pat. No. 5,732,452 discloses a dual-layer burial urn comprising a hollow outer decorative casing surrounding an inner resilient liner formed of a high-impact plastic. The outer casing is formed from a base and contains an opening at one end of its body, with a recess surrounding the opening. The inner liner has a screw-threaded aperture aligned with the opening and the recess. An inner plastic top having a screw-threaded portion for engaging the aperture of the inner liner is provided for sealing the inner liner.

The 2009/0020488A1 published patent discloses a shatterproof urn for cremation remains that includes an outer shell defining an interior volume and having an interior surface and an opening for the placement and removal of contents from the interior volume. The outer shell is fabricated from a hard and durable material. A resilient and/or flexible lining is disposed on the interior surface of the outer shell and may partly adhere to the interior surface. A lid is provided and is size for sealed placement over the opening in the outer shell.

For background purposes and indicative of the art to which the invention relates, reference may be made to the following remaining patents found in the patent search.

| Pat. No. | INVENTOR | ISSUED |
|---|---|---|
| Des.400,683 | Saar et al | 3 Nov. 1998 |
| 900,980 | Callahan, et al | 13 Oct. 1908 |
| 1,048,361 | Sievert | 24 Dec. 1912 |
| 1,454,427 | Cunning | 8 May 1923 |
| 1,484,896 | Mannix | 26 Feb. 1924 |
| 1,903,197 | Scott | 28 Mar. 1933 |
| 1,974,666 | Scott | 25 Sept. 1934 |
| 2,261,651 | Lambert | 4 Nov. 1941 |
| 3,654,676 | McHugh | 11 Apr. 1972 |
| 4,170,054 | Ruffner et al | 9 Oct. 1979 |
| 4,320,562 | Kelley | 23 Mar. 1982 |
| 4,372,018 | Miller, IV et al | 8 Feb. 1983 |
| 4.823,448 | Martin | 25 Apr. 1989 |
| 4.854,018 | Von Bratt | 8 Aug. 1989 |
| 5,157,817 | Davidian | 27 Oct. 1992 |
| 5,745,733 | Goria | 21 Sep. 1993 |
| 5,379,499 | Jackson | 10 Jan. 1995 |
| 5,722,133 | Farris et al | 3 Mar. 1998 |
| 6,145,175 | Enneking, et al | 14 Nov. 2000 |

-continued

| Pat. No. | INVENTOR | ISSUED |
|---|---|---|
| 2010/0088866 A1 | Fifer et al | Pub. 15 Apr. 2010 |
| 2013/0125357 A1 | Drew et al | 23 May 2013 |
| 2014/0000075 A1 | Catlett | 2 Jan. 2014 |
| 2014/0090216 A1 | Kotila et al | 3 Apr. 2014 |

DISCLOSURE OF THE INVENTION

In its basic embodiment, the cremation urn is comprised of an internal structure having an opening, an external structure having an opening, and sealing means in the form of a threaded lid. The internal structure is integrally located within the external structure and is placed therein during a proprietary molding manufacturing method. The two structures are molded together, with each respective opening dimensioned to and correspondingly aligned with each other. A threaded flange is attached to, and molded into the opening. A threaded lid with an inner perimeter gasket is then screwed into the flange, thereby creating a one-piece, seamless, air-tight and water-tight cremation urn. The materials utilized to manufacture the urn produce an appearance and texture of real marble. This type of simulated synthetic marble is commonly known as cultured marble which is a cast polymer product. In addition to the manufacturing method that produces a one-piece cremation urn, an alternate manufacturing method can be utilized that provides a two-piece cremation urn with a separate lower surface that is attached onto the external structure. The two-piece manufacturing method is more economical but does not produce a cremation urn that is as structurally sound as the one-piece seamless method, or possess the air-tight and water-tight attributes.

In view of the above disclosure, the primary object of the invention is to produce a high quality cultured marble cremation urn that utilizes a one-piece design to produce an aesthetically pleasing seamless, air-tight and water-tight urn that is made by a proprietary manufacturing method.

In addition to the primary object of the invention, it is also an object of the invention to produce a cultured marble cremation urn that:

- can be made in various sizes,
- can be made in various shapes,
- can be made of various materials,
- can be made in various colors,
- has the appearance of real marble,
- is durable and will remain intact for an extended time even when buried in the ground,
- provides a safe and secure repository for ashes within the urn,
- can be custom made to an individual's family's or friend's specifications,
- is more earth-friendly than other burial devices such as a coffin,
- has an under-stated attractive appearance that would not be obtrusive or awkward in a home, and
- is cost effective from both a manufacturer's and consumer's point of view.

These and other objects and advantages of the present invention will become apparent from the subsequent detailed description of the preferred embodiment and the appended claims taken in conjunction with the accompanying drawings.

BRIEF DESCRIPION OF THE DRAWINGS

BEST MODE FOR CARRYING OUT THE INVENTION

Figure 1:
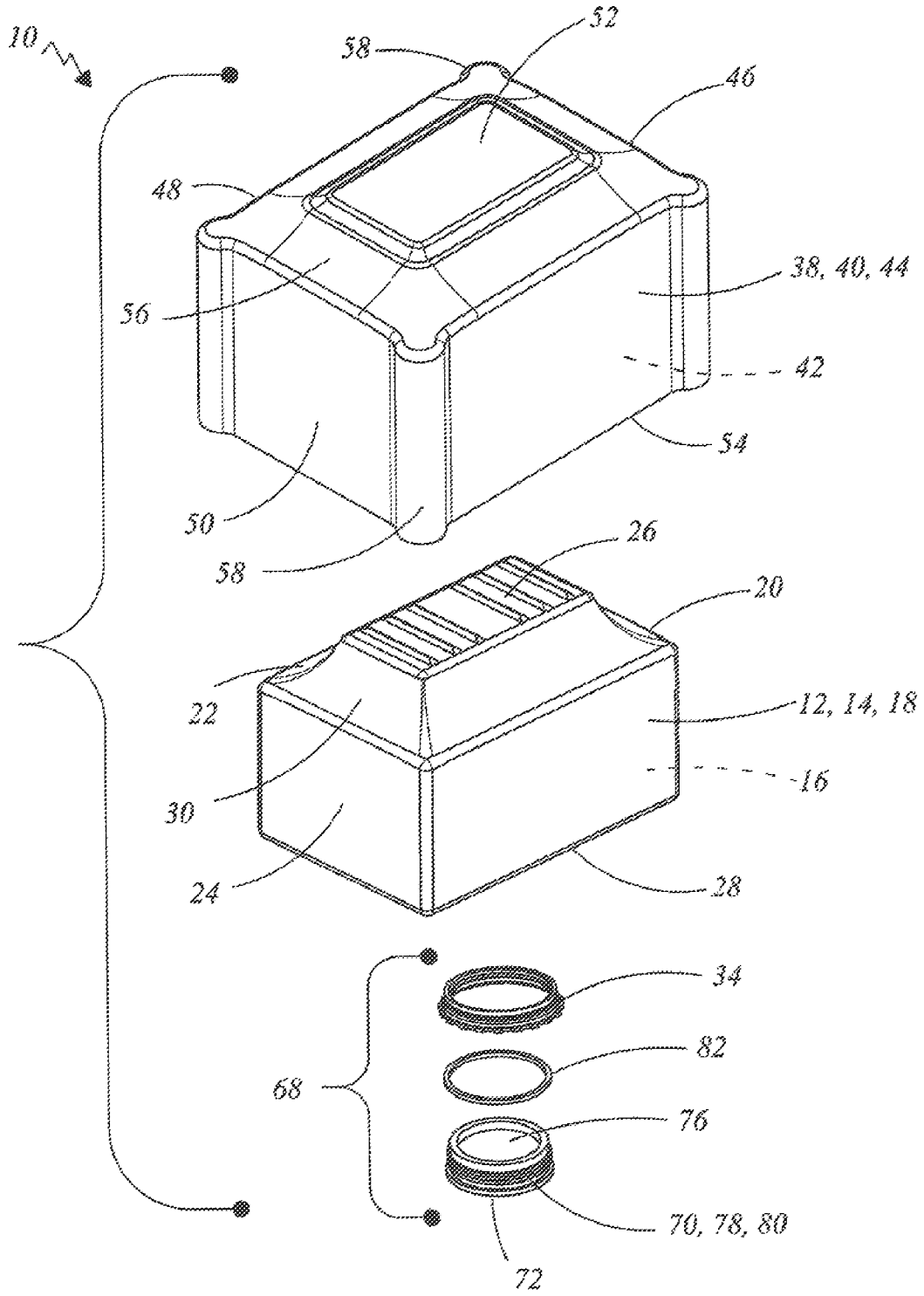
FIG. 1 is an orthographic exploded view of the cremation urn showing the external structure, the internal structure and the elements of the sealing means.

The best mode for carrying out the invention is presented in terms that disclose a preferred structural embodiment of, and multiple manufacturing methods for, a cremation urn. In the modern world, especially in developed nations, there are two primary ways of dealing with a dead human body. The first way is to bury the body along with a coffin, or place the body and coffin in an above-ground mausoleum. Both burying in the ground and placing a body and coffin in a mausoleum require a significant financial cost. More importantly, both of these require an amount of space that is becoming less available.

The second way of dealing with a dead human body is to burn or cremate the body. In regard to space requirements, cremation is preferred since all that remains after cremation are a relatively small amount of ashes, which are then placed in a suitable container, which typically consists of an urn.

The problem is that many cremation urns are actually not suitable for human ashes. The instant cremation urn offers a solution to this by providing a cremation urn that has an internal structure for maintaining and protecting the ashes, and an external structure that encases and protects the internal structure. The instant cremation urn has an aesthetically pleasing appearance while providing a safe and secure location to maintain human ashes either for burial, placement in a mausoleum, or keeping in a home or other location.

The cremation urn 10, as shown in FIGS. 1-11, is comprised of the following major elements: an internal structure 12, an external structure 38, and sealing means 68 in the form of a lid 70.

The internal structure 12, as shown in FIGS. 1-6, is preferably made of plastic by a blow mold process. Other materials, including rubber, metal, concrete, wood, ceramic, glass, fiberglass, biodegradable material or other synthetics can also be utilized. The internal structure 12 is preferably substantially rectangular in shape, but can be made in any geometric or non-geometric shape. For the purpose of this disclosure, the substantially rectangular design will be described and shown.

The internal structure 12 has an outer surface 14, an inner surface 16, a first side surface 18, a second side surface 20, a third side surface 22, a fourth side surface 24, an upper surface 26, and a lower surface 28. As shown in FIGS. 1, 2, 3 and 6, along each side of the internal structure's upper surface extends an upward and inward section 30 that terminates at the substantially flat upper surface 26. Located on the lower surface 28 is an opening 32, as shown in FIG. 7. Prior to molding the urn, a threaded flange 34 is attached to the opening 32.

Figure 2:
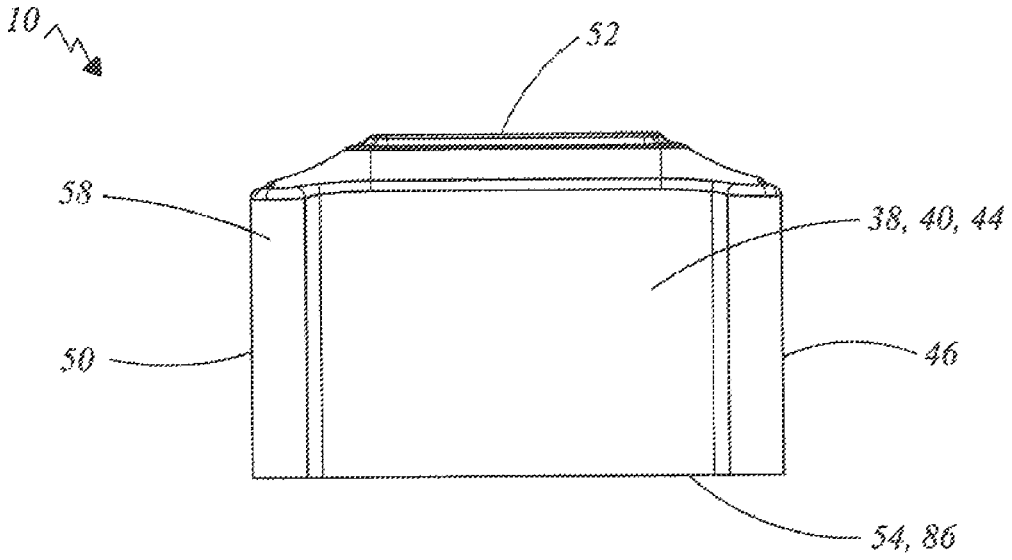
FIG. 2 is a front elevational view of a cremation urn.
Figure 3:
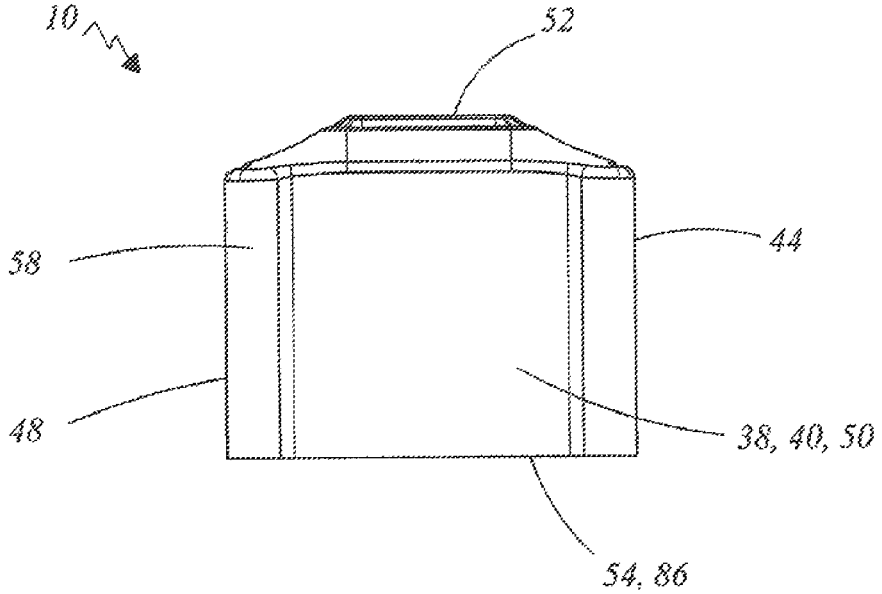
FIG. 3 is a side elevational view of the cremation urn.
Figure 4:
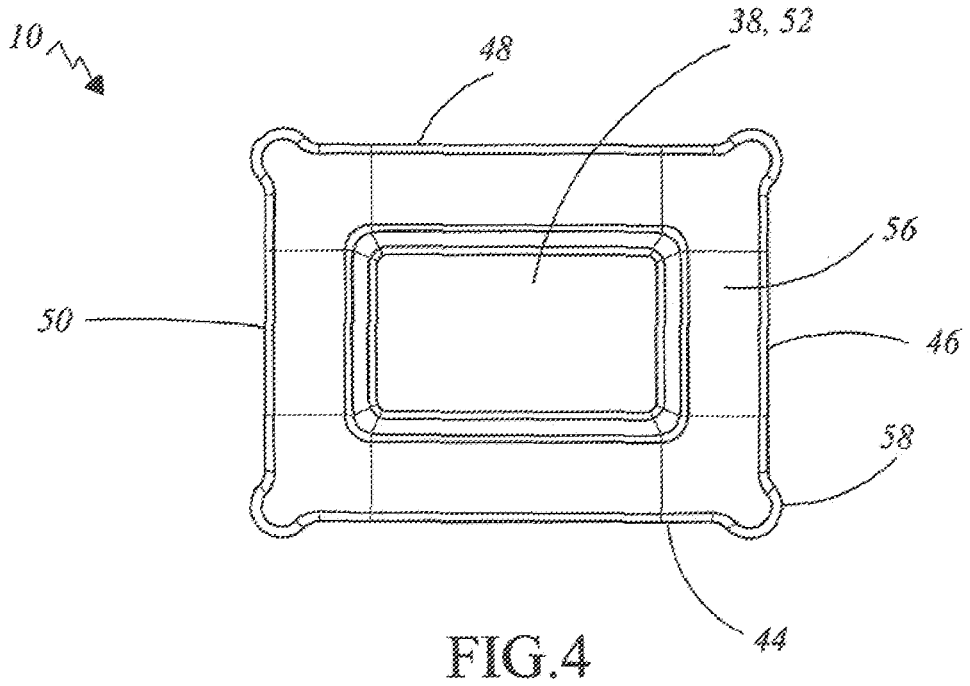
FIG. 4 is a top plan view of the cremation urn.
Figure 5:
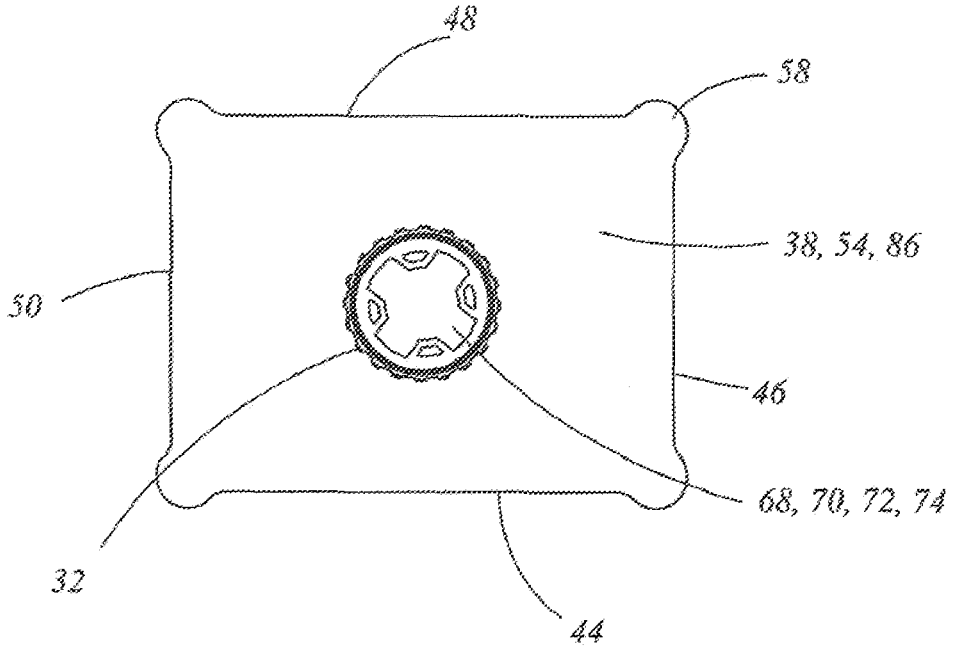
FIG. 5 is a bottom plan view of the cremation urn.
Figure 6:
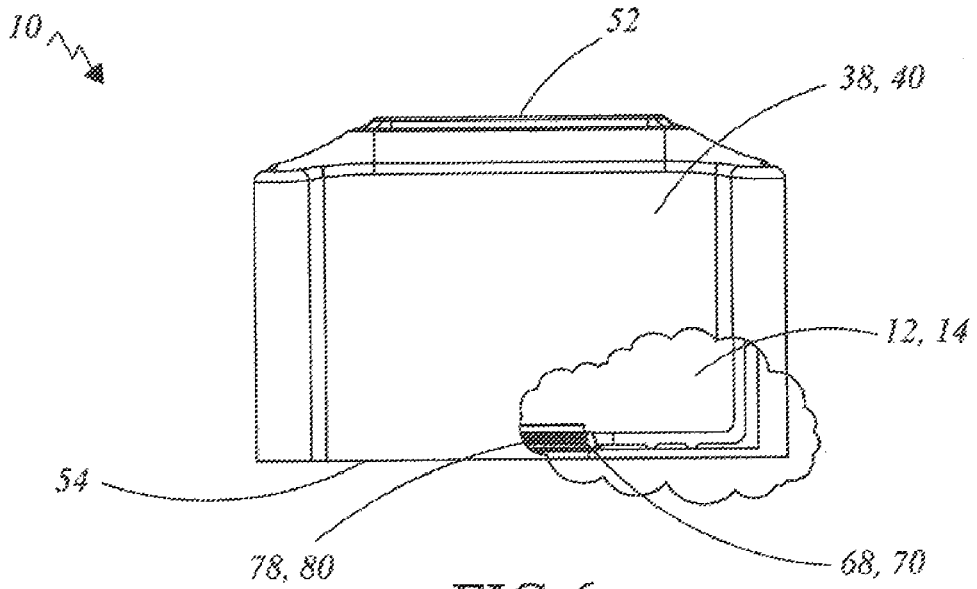
FIG. 6 is a cut-a-way view of the cremation urn showing a corner of an internal structure.
Figure 7:
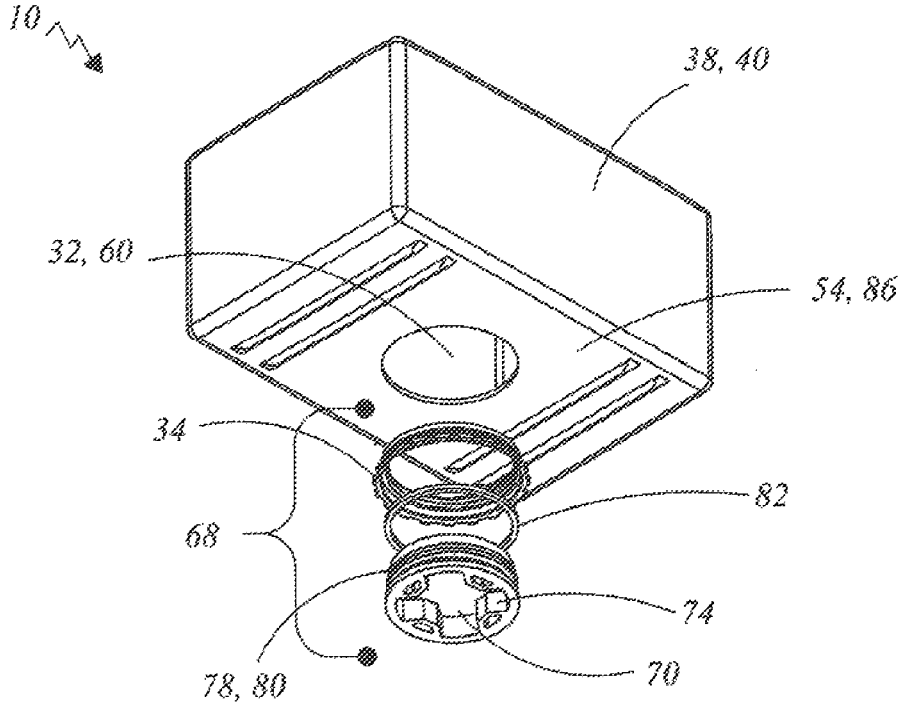
FIG. 7 is an orthographic bottom view of the cremation urn showing an exploded view of sealing means comprising a threaded flange, threaded lid and gasket.

The external structure 38, as shown FIGS. 1-7, is preferably made of a material known as cultured marble, which is a synthetic material that has the appearance and texture of real marble. The external structure 38 is made by a molding manufacturing method. Although cultured marble is the preferred material, the external structure 38 can be made of other materials including rubber, plastic, metal, concrete, wood, ceramic, glass, fiberglass, biodegradable material or other synthetics. The shape of the external structure 38 corresponds to the shape of the internal structure 12, with the external structure 38 dimensioned slightly larger to allow the internal structure to be placed within the external structure, as shown in FIGS. 1 and 6. As shown in FIGS. 1, 2 and 3, the external structure 38 has an outer surface 40, an inner surface 42, a first side surface 44, a second side surface 46, a third side surface 48, a fourth side surface 50, an upper surface 52 and a lower surface 54. As with the internal structure, along each side of the external structure's upper surface extends an upward and inward section 56 that terminates at the substantially flat upper surface 52. Also, at each corner where the respective sides interface is a rounded section 58, as shown in FIGS. 1, 2 and 3, which provides an aesthetic column. Located on the lower surface of the external structure 38 is an opening 60 that is dimensioned to and correspondingly aligned with the opening 32 on the internal structure 12. After the urn 10 is made, the two openings 32,60 allow human remains in the form of ashes to be placed into the internal structure 12.

In order to maintain the ashes within the urn 10, the sealing means 68 is utilized. As shown in FIGS. 1, 5 and 7, the sealing means 68 is in the form of a lid 70 comprising an outer surface 72 with an indented area having at least one finger tab 74, an inner surface 76, an outer perimeter 78 with threads 80 that correspond to the threads on the flange 34, and a gasket 82 to provide a tight seal of the lid. A lid 70 having four finger tabs 74, is shown in FIGS. 5 and 7. To access the internal structure 12, or to seal the urn 10 once ashes have been placed within the urn, the lid 70 is screwed into or out of the threaded flange. Since the lid 70 sits flush with the outer surface of the external structure 38, the finger tabs 74 allow a person to acquire a grasp of the lid and to rotate the lid when screwing the lid on or off. Additionally, a lid 70 without finger tabs can also be effectively utilized.

After an urn 10 has been made, a flocking material 86 is applied onto the lower surface of the external structure 38, as shown in FIGS. 5 and 7. The flocking material is either a sprayed substance or pre-cut to size flocked craft paper with pressure sensitive coating, which is also known as an adhesive.

Figure 8:
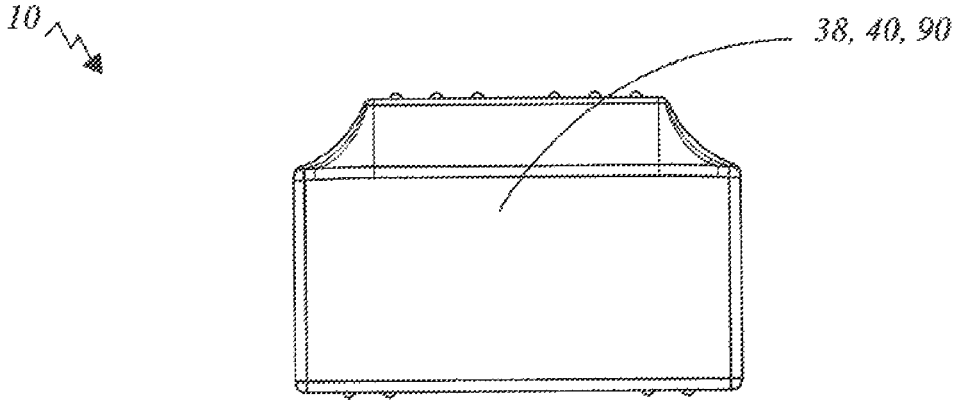
FIG. 8 is a front elevational view of the cremation urn showing the external structure of the urn with the appearance including color and veining of marble.

As previously disclosed the cremation urn is preferably made of cultured marble by a manufacturing method comprised of molding. The cultured marble material produces an urn with an attractive appearance of real marble, complete with marble color and veining 90, as shown in FIG. 8. Preferably the molds used to fabricate the external structure are made of fiberglass, but the molds can be made of other materials including metal, rubber or concrete.

Figure 9:
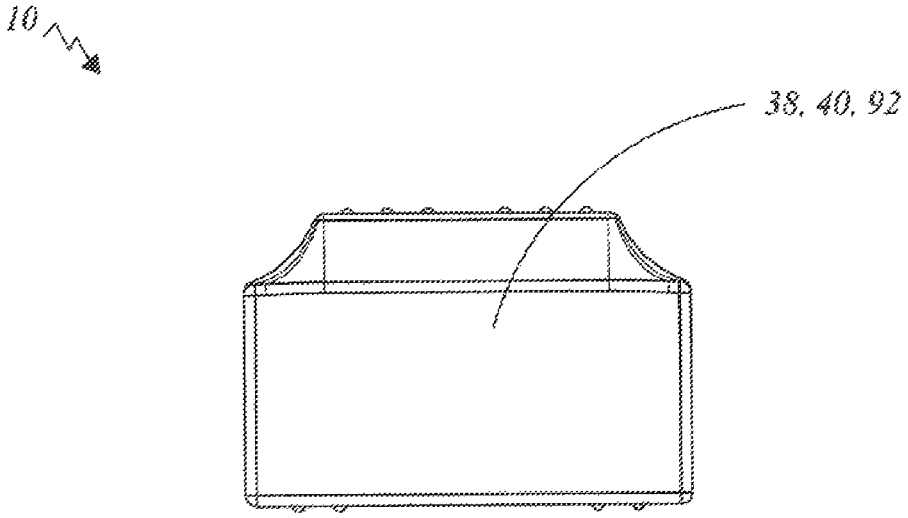
FIG. 9 is a front elevational view of the cremation urn showing the external structure of the urn having a vinyl wrap.
Figure 10:
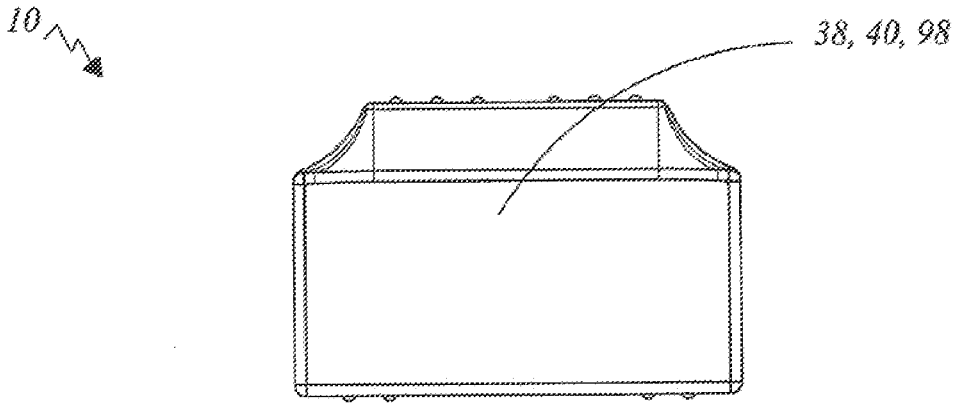
FIG. 10 is a front elevational view of the cremation urn showing the external structure of the urn painted.
Figure 11:
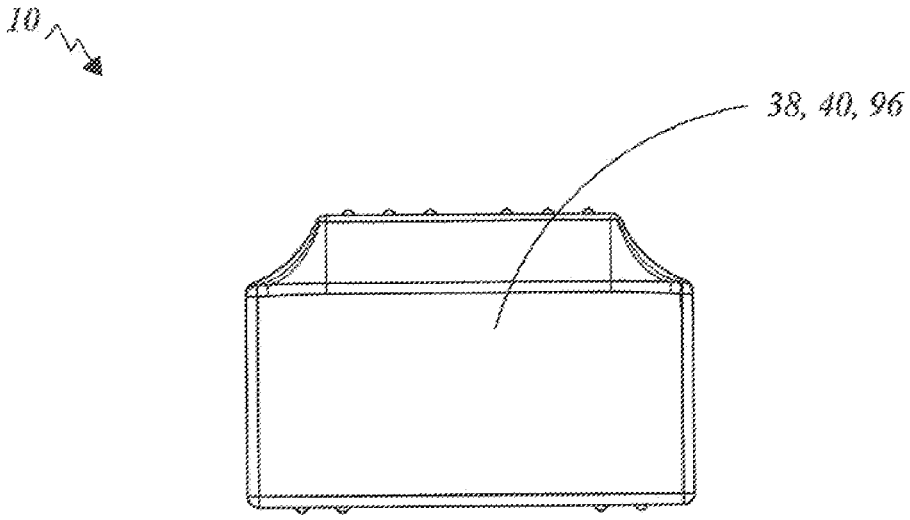
FIG. 11 is a front elevational view of the cremation urn showing the external structure of the urn with spray stone applied.

During manufacture a pigment is added to produce the color and marble appearance of the urn 10. If desired, the pigment can be omitted which results in an urn with a comparatively un-attractive creamy brown appearance. Omitting the pigment is utilized when other outward appearances of the urn are desired. Some examples of other appearances include: a vinyl wrap 52 that tightly adheres to the outer surface of the external structure 38. The wrap 52, as shown in FIG. 9, can be any color or have any image printed thereon. Another alternate appearance is a simple painted external structure, as shown in FIG. 10. The paint 98 can be applied by spray or brush and can be any conceivable color or any image desired. Similar to paint is a finish known as spray stone or spray granite which, as its name implies is sprayed onto the external structure's outer surface and gives the appearance of natural stone or rock, as shown in FIG. 11. When an urn is made of metal or plastic, the outer surface can be plated with a material such as chrome or gold (not shown). An aluminum urn can have an anodized surface. These are examples to indicate that the instant cremation urn 10 is not limited to any specific material or appearance/finish option. Additionally, to add to the appearance and/or functionality of the urn 10, text, either applied such as with paint or engraved, and/or images such as a photograph of the deceased person, can be placed on the external structure's outer surface. Other images that reflect the deceased person's interests or hobby can also be utilized.

There are two main manufacturing methods. The first, preferred method is comprised of the following steps:

A. Acquire a blow mold far an urn internal structure, wherein the blow mold has an opening in a lower section.

B. Attach a threaded flange with no drain holes to the blow mold, with the flange being locked into the opening to create a tight seal and fit.

C. Insert a toggle bolt into the blow mold with the threaded shaft of the bolt passing through a center section of a plastic support holder for the flange.

D. Continue inserting the bolt's threaded shaft through an opening on a weighted metal plate which has metal stud supports to stabilize and maintain the blow mold attached to the plate.

E. Secure the toggle bolt with a wing nut.

F. Acquire a mold for an urn external structure.

G. Prepare the mold by applying to the inner surface a coating of release agent.

H. Apply unsaturated polyester clear gel coat monomer to the mold, and allow to air dry.

I. Prepare a matrix for the external structure utilizing unsaturated polyester resin.

J. Add methyl ethyl ketone peroxide or benzoyl peroxide which functions as a catalyst to cure the matrix at room temperature.

K. Add calcium carbonate fillers or aluminum trihydrates to the resin.

L. Add organic or inorganic pigments or titanium dioxide to the matrix to create a desired color.

M. Insert the matrix into the mold and pull the matrix up on the sides of the mold.

N. Insert the internal structure blow mold with weighted metal plate attached into a cavity in the external structure mold.

O. Align guide pins with openings in the external structure mold, thereby centering the internal blow mold within the external mold.

P. Allow the matrix to flow on all sides and bottom of the external mold.

Q. Vibrate the external mold to level the matrix and to fill any empty voids between the internal blow mold and the external structure.

R. Allow the matrix within the external mold to cure.

S. Loosen the toggle bolt which allows the weighted metal plate to be removed.

T. Remove the toggle bolt and wing nut from the internal blow mold.

U. Remove from the mold the complete urn which comprises the urn external structure and the urn internal structure within the external structure.

V. Sand the lower surface of the urn.

W. Fill any voids and air pockets on lower surface with a filling compound, then sand lower surface.

X. Buff exterior surfaces of urn.

Y. Apply epoxy paint onto the urn's lower surface.

Z. Spray rayon flocking material onto urn's lower surface.

AA. Wipe edges of urn's lower surface with acetone.

BB. Vacuum interior of blow mold.

CC. Screw a removable sealing means in the form of a threaded lid onto the threaded flange in the opening which extends through both the internal structure and the external structure.

The second alternate method is similar to the first method except a separate, pre-made lower surface is utilized instead of the one-piece design of the first method. The second method comprises the following straps:

A. Acquire a mold for an urn lower surface having an opening and an attached threaded flange.

B. Prepare a resin matrix.

C. Insert the resin matrix into the lower surface mold and allow to cure.

D. Remove the urn lower surface from the mold.

E. Acquire a blow mold for an urn internal structure, wherein the blow mold has an opening on a lower surface.

F. Insert a toggle bolt having a nut into the blow mold with the threaded shall of the bolt passing through the flange opening.

G. Continue inserting the bolt's threaded shaft through an opening on a weighted metal plate.

H. Secure the toggle bolt with a wing nut.

I. Acquire a mold for an urn external structure.

J. Prepare the mold by applying to the inner surface a coating of release agent.

K. Apply unsaturated polyester clear gel coat monomer to the mold, and allow to air dry.

L. Prepare a matrix for the external structure utilizing unsaturated polyester resin.

M. Add methyl ethyl ketone peroxide or benzoyl peroxide which functions as a catalyst to cure the matrix at room temperature.

N. Add calcium carbonate fillers or aluminum trihydrates to the resin.

O. Add organic or inorganic pigments or titanium dioxide to the matrix to create a desired color.

P. Insert the matrix into the mold and pull the matrix up on the sides of the mold.

Q. Insert the internal structure blow mold with weighted metal plate attached into a cavity in the external structure mold.

R. Allow the matrix to flow on all sides of the external mold.

S. Vibrate the external mold to level the matrix and to fill any empty voids between the internal blow mold and the external structure.

T. Allow the matrix within the external mold to cure.

U. Loosen the toggle bolt nut which allows the weighted metal plate to be removed.

V. Remove the toggle bolt from the internal blow mold.

W. Remove from the mold the complete urn which comprises the urn external structure and the urn internal structure within the external structure.

X. Sand the lower surface of the urn.

Y. Remove the external structure with the internal structure from the mold.

Z. Attach by an attachment means the pre-made lower surface to the bottom of the external structure, with the opening on the lower surface aligned with the opening on the internal structure.

AA. Lightly sand the lower surface of the urn.

BB. Apply a pre-cut flocking material to the lower surface of the urn, and

CC. Screw a removable sealing means in the form of a threaded lid onto the threaded flange in the opening which extends through both the internal structure and the external structure.

Although the above two methods are the most widely used, the instant cremation urn 10 should not be limited to those only. Other methods can also be employed. For example, a manufacturing method that utilizes component parts of an urn. Each of the component parts, such as the side surfaces, the upper surface, etc. can be manually alternated together by an attachment means. No mold is utilized and the attachment means can be comprised of an adhesive, a plurality of screws, or nuts and bolts. Obviously, an urn manufactured by this method would not be as high quality or possess the air-tight and water-tight attributes as the previously disclosed preferred first method, but a cremation urn having an internal structure and an external structure could still be realized.

While the invention has been described in detail and pictorially shown in the accompanying drawings it is not to be limited to such details, since many changes and modification may be made to the invention without departing from the spirit and the scope thereof. Hence, it is described to cover any and all modifications and forms which may come within the language and scope of the claims.

The invention claimed is:

1. A cremation urn that is utilized to maintain human remains in the form of ashes, after a body has been cremated, wherein said urn has a substantially rectangular plastic internal structure comprising an outer surface, an inner surface, a first side surface, a second side surface, a third side surface, a fourth side surface, an upper surface, a lower surface, and an opening that is located on the lower surface; a substantially rectangular cultured marble external structure comprising an outer surface, an inner surface, a first side surface, a second side surface, a third side surface, a fourth side surface, an upper surface, a lower surface, and an opening that is dimensioned to and correspondingly aligned with the opening on said internal structure, and having a threaded flange placed along the internal perimeter of the opening of said external structure; and sealing means comprising a lid with an indented outer surface having two finger tabs, an inner surface, an outer perimeter with threads and a gasket, wherein said internal structure is smaller than said external structure and is dimensioned to allow said internal structure to fit within and follow the shape of said external structure, wherein said urn is manufactured so that said internal structure is permanently located within said internal structure with the location of the opening on said internal structure correspondingly aligned with the location of the opening on said external structure, wherein with the two respective openings aligned, the ashes can be inserted into said internal structure via the two openings, wherein once the ashes are within said internal structure, said sealing means in the form of said lid is screwed onto the threaded flange within the opening on said external structure, wherein the finger tabs on said lid allow said lid to be tightly and securely screwed onto the flange, and said lid along with the gasket on said lid provide a seal on the openings that results in an urn that maintains the ashes within said urn in a secure, air-tight and water-tight environment, wherein located on the lower surface of said urn's external structure is flocking material, wherein the cultured marble material that said external structure is made of has an appearance of actual marble, thereby providing said urn with an attractive appearance that can be selected from multiple colors and have unique veining that replicates the look of actual marble.

2. The cremation urn as specified in claim 1 wherein each corner, where the four sides interface, is rounded and extends outward in the shape of a semi-column.

3. The cremation urn as specified in claim 1 wherein from each side of said internal structure's upper surface extends an upward and inward section that terminates at a substantially flat surface.

4. The cremation urn as specified in claim 1 wherein from each side of said external structure's upper surface extends an upward and inward section that terminates at a substantially flat surface.

5. The cremation urn as specified in claim 1 wherein said internal structure is manufactured by a molding process.

6. The cremation urn as specified in claim 5 wherein the molding process is comprised of blow molding.

7. The cremation urn as specified in claim 5 wherein said external structure is manufactured by a molding process.

8. The cremation urn as specified in claim 5 wherein said external structure is made of a material secured from the group consisting of cultured marble, plastic, metal, rubber, concrete, ceramic, glass, fiberglass, biodegradable material or a synthetic material.

9. The cremation urn as specified in claim 5 wherein the flocking is comprised of a spray-on rayon flocking.

10. The cremation urn as specified in claim 5 wherein the flocking is comprised of craft paper with pressure sensitive adhesive coating.

11. The cremation urn as specified in claim 5 wherein the flocking is comprised of adhesive-backed felt.

12. The cremation urn as specified in claim 5 further comprising a vinyl wrap that is pressure-adhered to the outer surface of said external structure.

13. The cremation urn as specified in claim 12 wherein the vinyl wrap comprises a solid color, multiple colors or indicia.

14. The cremation urn as specified in claim 5 further comprising paint that is sprayed or brushed onto the outer surface of said external structure.

15. The cremation urn as specified in claim 5 further comprising spray stone that is applied to the outer surface of said external structure.

16. The cremation urn as specified in claim 1 wherein said internal structure is made of a material selected from the group consisting of plastic, metal, rubber, concrete, glass, fiberglass, biodegradable material or a synthetic material.

17. The cremation urn as specified in claim 1 wherein the threaded flange is made of metal or plastic and is integrally attached within the opening on said external structure during the molding manufacturing process.

18. A cremation urn that is utilized to maintain human remains in the form of ashes, after a body has been cremated, wherein said urn has a substantially rectangular plastic internal structure comprising an outer surface, an inner surface, a first side surface, a second side surface, a third side surface, a fourth side surface, an upper surface, a lower surface, and an opening that is located on the lower surface; a substantially rectangular cultured marble external structure comprising an outer surface, an inner surface, a first side surface, a second side surface, a third side surface, a fourth side surface, an upper surface, a lower surface, and an opening that is dimensioned to and correspondingly aligned with the opening on said internal structure, and having a threaded flange placed along the internal perimeter of the opening of said external structure; and sealing means comprising a lid with an indented outer surface having two finger tabs, an inner surface, an outer perimeter with threads and a gasket, wherein said internal structure is smaller than said external structure and is dimensioned to allow said internal structure to fit within and follow the shape of said external structure, wherein said urn is manufactured so that said internal structure is permanently located within said internal structure with the location of the opening on said internal structure correspondingly aligned with the location of the opening on said external structure, wherein with the two respective openings aligned, the ashes can be inserted into said internal structure via the two openings, wherein the finger tabs on said lid allow said lid to be tightly and securely screwed onto the flange, and said lid along with the gasket on said lid provide a seal on the openings that results in an urn that maintains the ashes within said urn in a secure, air-tight and water-tight environment, wherein located on the lower surface of said urn's external structure is flocking material, wherein the cultured marble material that said external structure is made of has an appearance of actual marble, thereby providing said urn with an attractive appearance that can be selected from multiple colors and have unique veining that replicates the look of actual marble.

* * * * *